US010959596B2

(12) United States Patent
Feddema et al.

(10) Patent No.: US 10,959,596 B2
(45) **Date of Patent: *Mar. 30, 2021**

(54) DISHWASHER WITH A SPRAY ARM SYSTEM HAVING A BEARING ASSEMBLY

(71) Applicant: WHIRLPOOL CORPORATION, Benton Harbor, MI (US)

(72) Inventors: Mark S. Feddema, Kalamazoo, MI (US); Blair D. Mikkelsen, Saint Joseph, MI (US); John A. Miller, Stevensville, MI (US); Kevin Miller, Lawton, MI (US); Alvaro Vallejo Noriega, Saint Joseph, MI (US); Antony M. Rappette, Benton Harbor, MI (US); Frederick T. Roderick, Coloma, MI (US); Pritish Roy, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/864,240

(22) Filed: May 1, 2020

(65) Prior Publication Data

US 2020/0253451 A1 Aug. 13, 2020

Related U.S. Application Data

(63) Continuation of application No. 14/970,925, filed on Dec. 16, 2015, now Pat. No. 10,682,037.

(51) Int. Cl.

| | |
|---|---|
| ***A47L 15/22*** | (2006.01) |
| ***A47L 15/42*** | (2006.01) |
| ***A47L 15/50*** | (2006.01) |

(52) U.S. Cl.
CPC ..... *A47L 15/22* (2013.01); *A47L 15/4221* (2013.01); *A47L 15/4261* (2013.01); (Continued)

(58) Field of Classification Search
CPC ..... A47L 15/16; A47L 15/18; A47L 15/20; A47L 15/22; A47L 15/23; A47L 15/4214; (Continued)

(56) References Cited

U.S. PATENT DOCUMENTS

| | | | |
|---|---|---|---|
| 2,665,700 | A | 1/1954 | Low |
| 2,956,572 | A | 10/1960 | Abresch et al. |

(Continued)

FOREIGN PATENT DOCUMENTS

| | | | |
|---|---|---|---|
| DE | 1628625 | A1 | 8/1970 |
| EP | 0766945 | B1 | 1/2002 |
| GB | 263768 | | 11/1926 |

OTHER PUBLICATIONS

German Search Report for DE102016122076.0, dated Sep. 1, 2017.

*Primary Examiner* — Marc Lorenzi
(74) *Attorney, Agent, or Firm* — McGarry Bair PC

(57) ABSTRACT

A dishwasher having a tub and spray arm assembly for a dishwasher having a spray arm assembly for spraying wash liquid in the tub. The spray arm assembly has spray arm inlet, a bearing assembly with a bearing body that defines a through passage with a bearing inlet and a bearing outlet fluidly coupled to the spray arm inlet. The spray arm assembly also has a liquid supply conduit with a supply outlet fluidly coupled to the bearing inlet, a seal positioned between the bearing body and the liquid supply conduit; and a deflector provided within the supply outlet to effectively divide the supply outlet into at least two portions. At least one of the two portions faces upstream and defining an effective cross-sectional area confronting the bearing inlet (Continued)

that is less than or equal to the cross-sectional area of the bearing inlet. The deflector is also aligned with the bearing inlet and defines a turn in the supply outlet for directing liquid into the bearing inlet.

13 Claims, 5 Drawing Sheets

(52) U.S. Cl.
CPC ..... *A47L 15/4285* (2013.01); *A47L 15/4293* (2013.01); *A47L 15/502* (2013.01); *A47L 15/507* (2013.01)

(58) Field of Classification Search
CPC ..... A47L 15/4217; A47L 15/4219; A47L 15/4221; F16L 43/00
See application file for complete search history.

(56) References Cited

U.S. PATENT DOCUMENTS

| | | | |
|---|---|---|---|
| 2,973,907 | A | 3/1961 | Levit et al. |
| 3,323,529 | A | 6/1967 | Gieger et al. |
| 3,599,872 | A | 8/1971 | Guth |
| 3,672,573 | A | 6/1972 | Morgan |
| 5,673,716 | A | 10/1997 | Gurubatham et al. |
| 7,594,513 | B2 | 9/2009 | VanderRoest et al. |
| 7,931,214 | B2 | 4/2011 | Goetz et al. |
| 2006/0054204 | A1 | 3/2006 | Fischer |
| 2006/0104792 | A1 | 5/2006 | Giuliano |

DISHWASHER WITH A SPRAY ARM SYSTEM HAVING A BEARING ASSEMBLY

CROSS-SECTION TO RELATED APPLICATIONS

The present application is a continuation of U.S. patent application Ser. No. 14/970,925, filed Dec. 16, 2015, now U.S. Pat. No. 10,682,037, which is hereby incorporated by reference herein in its entirety.

BACKGROUND

Contemporary dishwashers typically have a recirculation circuit including a sump from which water is collected and pumped to a rotating spray arm for distribution within the wash chamber of the dishwasher. The effectiveness of the liquid sprayed from the rotating spray arm is dependent upon the pressure of the liquid supplied to the spray arm.

In the context of a rotating spray arm, a bearing assembly typically couples the rotating spray arm to a liquid supply conduit from the pump. Often there is a pressure loss at the interface of the supply conduit and the rotating spray arm. This pressure loss reduces the effectiveness of the liquid sprayed from the rotating spray arm.

The pressure loss is typically attributable to a gap between the bearing assembly and the supply conduit through which the liquid can escape. Prior solutions have provided for a seal at the interface between the bearing assembly and the liquid supply conduit to reduce the loss of water through the interface, thereby reducing the pressure loss. However, the seal alone is not a perfect solution for reducing the pressure loss.

Another source of pressure loss is attributable to the bearing assembly providing a larger volume area in which the liquid supplied through the liquid supply conduit can diverge resulting in a pressure drop.

SUMMARY

In one aspect, the invention relates to a dishwasher for treating dishes according to at least one automatic cycle of operation. The dishwasher has a tub at least partially defining a treating chamber receiving dishes for treating and a spray arm assembly for spraying wash liquid in the tub. The spray arm assembly comprises a spray arm with a spray arm inlet and a bearing assembly with a bearing body that defines a through passage with a bearing inlet and a bearing outlet fluidly coupled to the spray arm inlet. The spray arm assembly also has a liquid supply conduit with a supply outlet fluidly coupled to the bearing inlet, a seal positioned between the bearing body and the liquid supply conduit; and a deflector provided within the supply outlet to effectively divide the supply outlet into at least two portions. At least one of the two portions faces upstream and defining an effective cross-sectional area confronting the bearing inlet that is less than or equal to the cross-sectional area of the bearing inlet. The deflector is also aligned with the bearing inlet and defines a turn in the supply outlet for directing liquid into the bearing inlet.

In another aspect, the invention relates to a dishwasher for treating dishes according to at least one automatic cycle of operation. The dishwasher comprises a tub at least partially defining a treating chamber receiving dishes for treating and a spray arm assembly for spraying wash liquid in the tub. The spray arm assembly comprises a spray arm that has a spray arm inlet, a bearing assembly that has a bearing body that defines a vertical through passage with a bearing inlet and a bearing outlet fluidly coupled to the spray arm inlet, and a liquid supply conduit with a cross-section. The liquid supply conduit is positioned orthogonal to the through passage and transitions 90 degrees to a supply outlet fluidly coupled to the bearing inlet. The spray arm assembly also has a seal positioned between the bearing body and the liquid supply conduit and a deflector is provided within the supply outlet to effectively divide the supply outlet into at least two portions. The deflector is aligned with the bearing inlet and defines a 90 degree turn in the supply outlet for directing liquid into the bearing inlet.

DRAWINGS

DESCRIPTION

Figure 1:
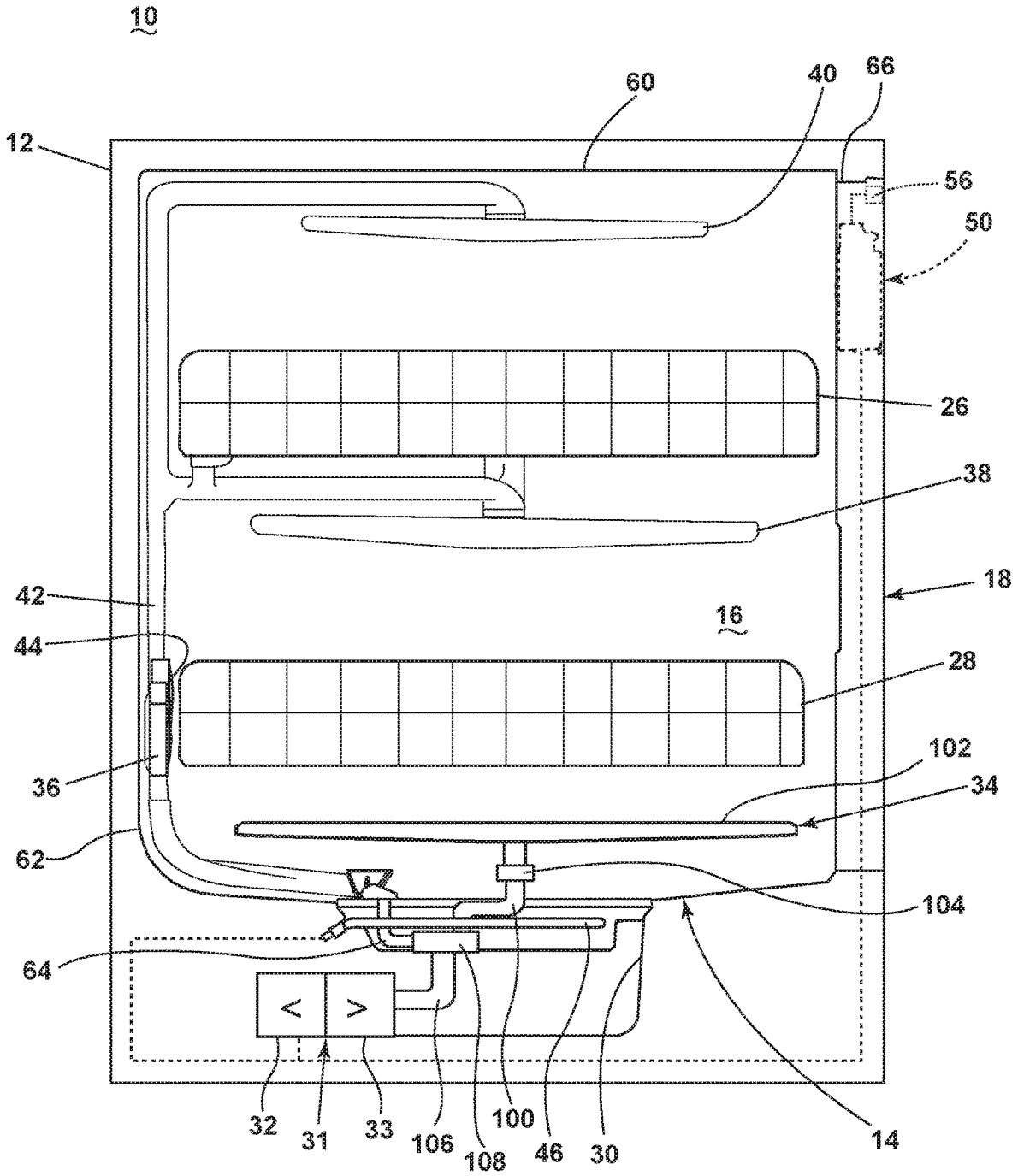
FIG. 1 is a side schematic view of a dishwasher incorporating the spray arm according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a pump outlet 106 to a diverter valve 108, which diverts the liquid to each of the assemblies 34, 36, 38, 40 for selective spraying. A liquid supply conduit 100 supplies the liquid to the lower spray arm assembly 34 through a bearing assembly 104. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
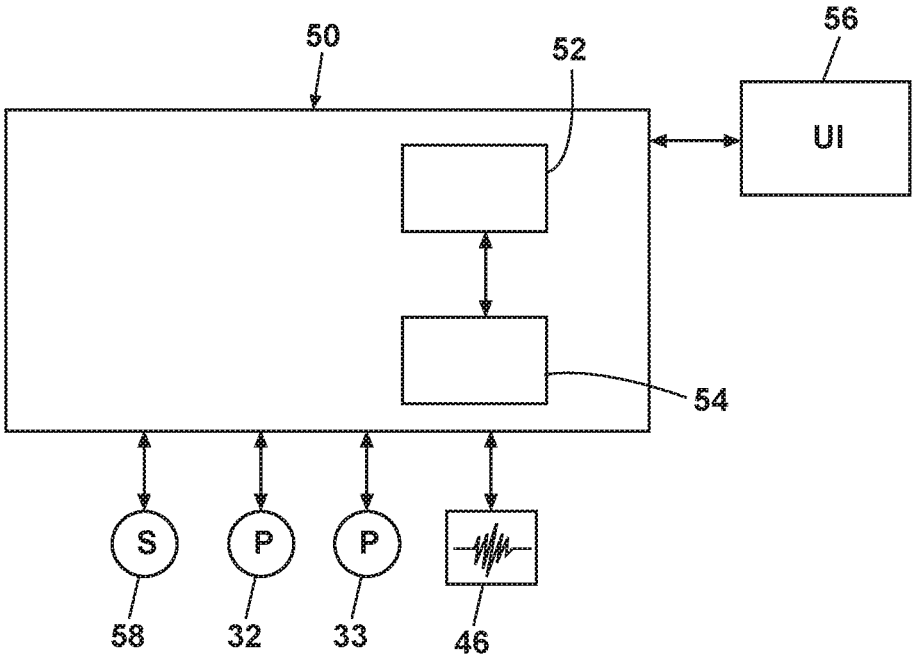
FIG. 2 is a schematic view of a controller for controlling the operation of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
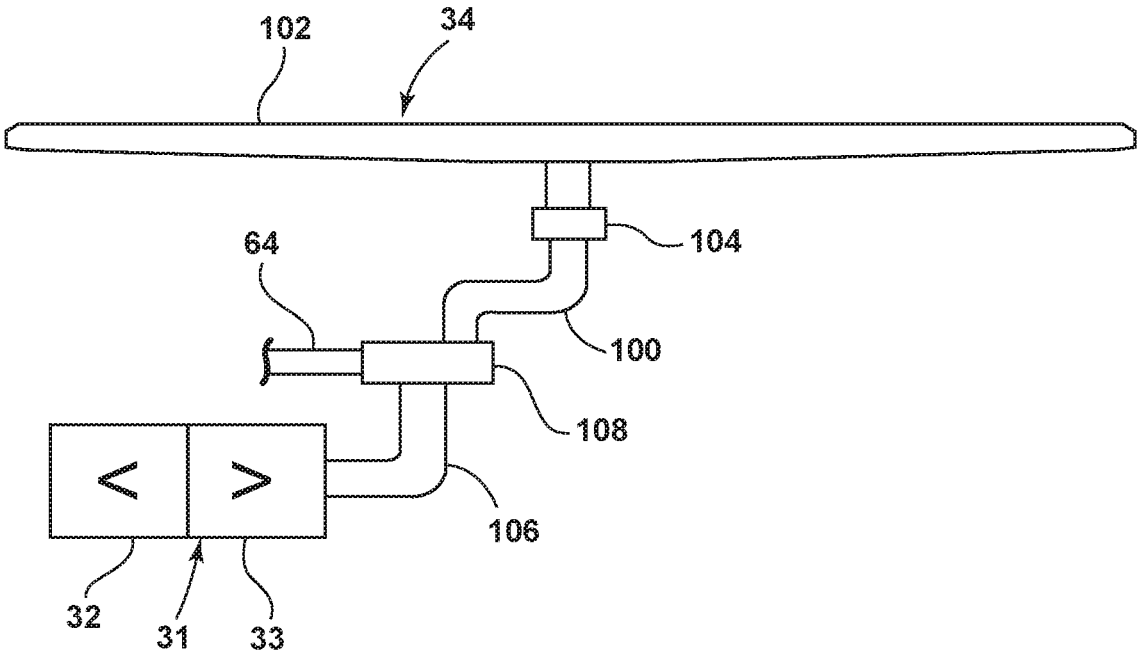
FIG. 3 is an enlarged schematic view of the spray arm assembly of FIG. 1.

Referring now to FIG. 3, the details of the spray arm assembly 34 will be described. The spray arm assembly 34 includes a liquid supply conduit 100 fluidly coupled to a rotating spray arm 102 through a bearing assembly 104. The liquid supply conduit 100 is provided liquid from the recirculation pump 33 through an outlet conduit 106, into a diverter valve 108. The diverter valve 108 can be operated by the controller 50 to divert the water from the recirculation pump 33 to either the supply conduit 64 or the supply conduit 100. The bearing assembly 104 fluidly couples the liquid supply conduit 100 to the rotating spray arm 102 along with providing for the relative rotation of the rotating spray arm 102 and the liquid supply conduit 100.

Figure 4:
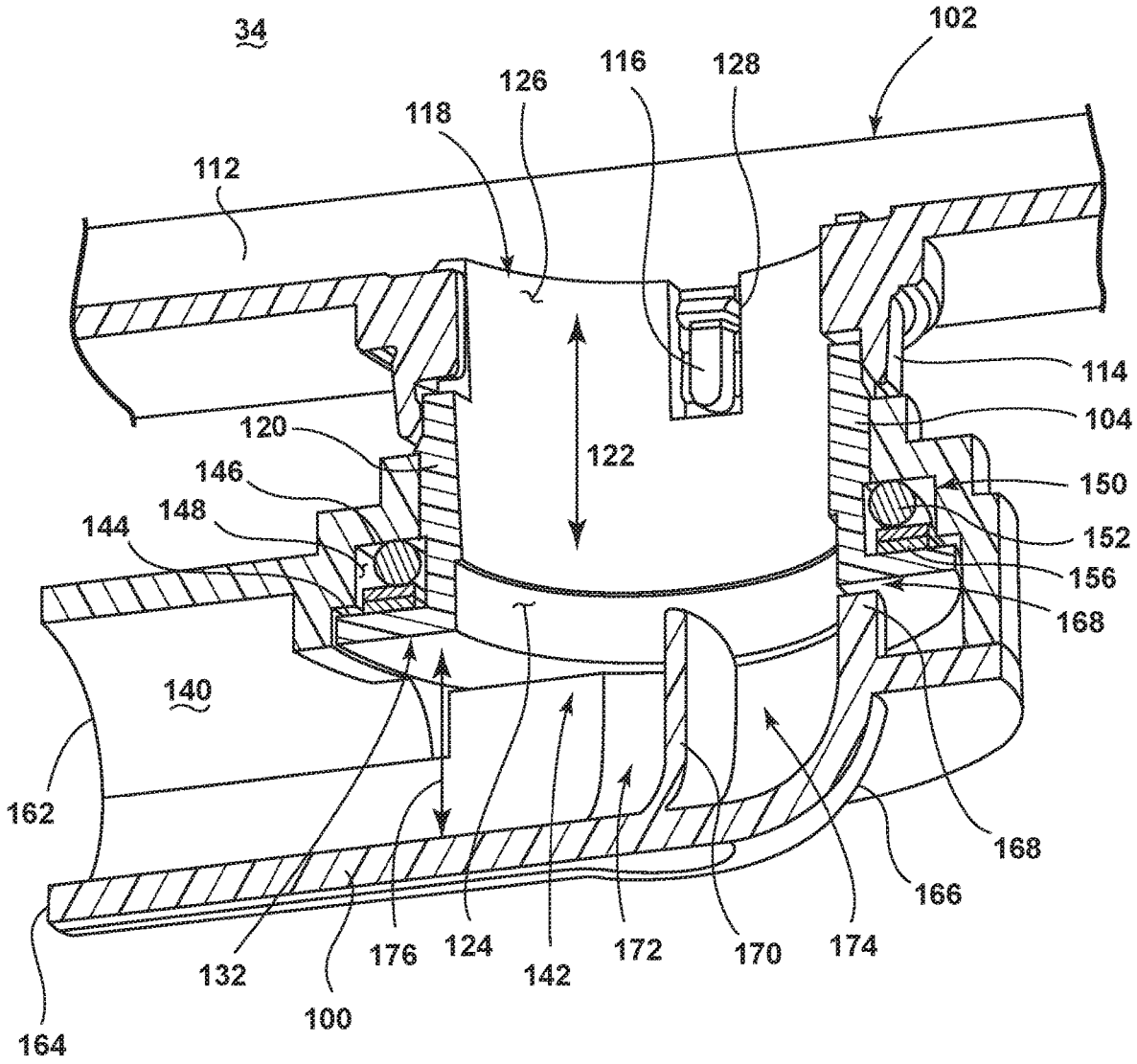
FIG. 4 is a sectional perspective view of a spray arm assembly for the dishwasher of FIG. 1.

Referring to FIG. 4, the interface of the liquid supply conduit, rotating spray arm 102, and the bearing assembly 100 or is shown in greater detail. The rotating spray arm 102 defines a hollow interior 112 and has a collar 114 providing access to the hollow interior 112 through a side of the rotating spray arm 102. The collar 114 includes pins 116, which are used to rotationally fix the bearing assembly 104 relative to the rotating spray arm 102. The collar 114 defines a spray arm inlet 118.

The bearing assembly 104 comprises a bearing body 120 defining a through passage 122 having an inlet 124 and an outlet 126. The bearing body 120 has slots 128 which are complementary to the pins 116, such that the outlet end of the bearing body 120 can be inserted into the spray arm inlet 118 with the pins 116 sliding within the slots 128 to limit the relative rotation of the spray arm 102 and the bearing body 120. The insertion of the bearing body 120 into the spray arm inlet 118 fluidly couples the through passage 122 to the hollow interior 112 of the spray arm 102.

The bearing body 120 further comprises a shoulder 132 that circumscribes the bearing outlet 126. The shoulder 132, while shown at the terminal end of the bearing body 120, could be at any location along the bearing body 120.

The liquid supply conduit 100 defines a hollow interior 140 and terminates in a liquid supply conduit outlet 142. Near the liquid supply conduit outlet 142, the liquid supply conduit 100 defines stepped surfaces 144, 146, which form a seat 148.

A seal 150 is formed in part by the seat 148 on the liquid supply conduit 100, and the shoulder 132 formed on the bearing body 120 overlying the seat 148, which collectively define a chamber in which a seal element 152, such as an o-ring seal, and friction reducer 154, such as rings 156 made from polytetrafluoroethylene (PTFE), are located. It should be recognized that the seat 132 could be formed on the bearing body 120 and the shoulder 132 could be formed on the liquid supply conduit 100. The seal 150 provides for fluidly sealing the bearing body 120 to the liquid supply conduit 100, while permitting their relative rotation. The space formed by the seat 148 and shoulder 132 is such that the seal element 152 is slightly compressed. One of the rings 156 generally remains generally in contact with the seal element 152 and the other ring 156 remains in contact with the shoulder 132. The relative rotation of the bearing body 120 and the liquid supply conduit 100 is accomplished by the relative rotation of the rings 156.

The liquid supply conduit 100 comprises upper and lower portions 162, 164, which may be separated to provide access to the hollow interior 140. The lower portion 164 defines a generally hemispherical portion 166 having a depending wall 168 that lies adjacent or abuts the shoulder 132 of the bearing body 120, which provides a bearing surface interface 169 between the liquid supply conduit 100 and the bearing body 120.

A deflector 170 extends from the lower portion 164 toward the bearing body inlet 124. The deflector 170 and the interior of the hemispherical portion 166 divide the liquid supply conduit outlet 142 into first and second portions 172, 174. The first portion 172 defines an effective outlet for the liquid supply conduit 100 and is of a smaller cross-sectional area than the cross-sectional area of the through passage 122 for the bearing body 120.

Figure 5:
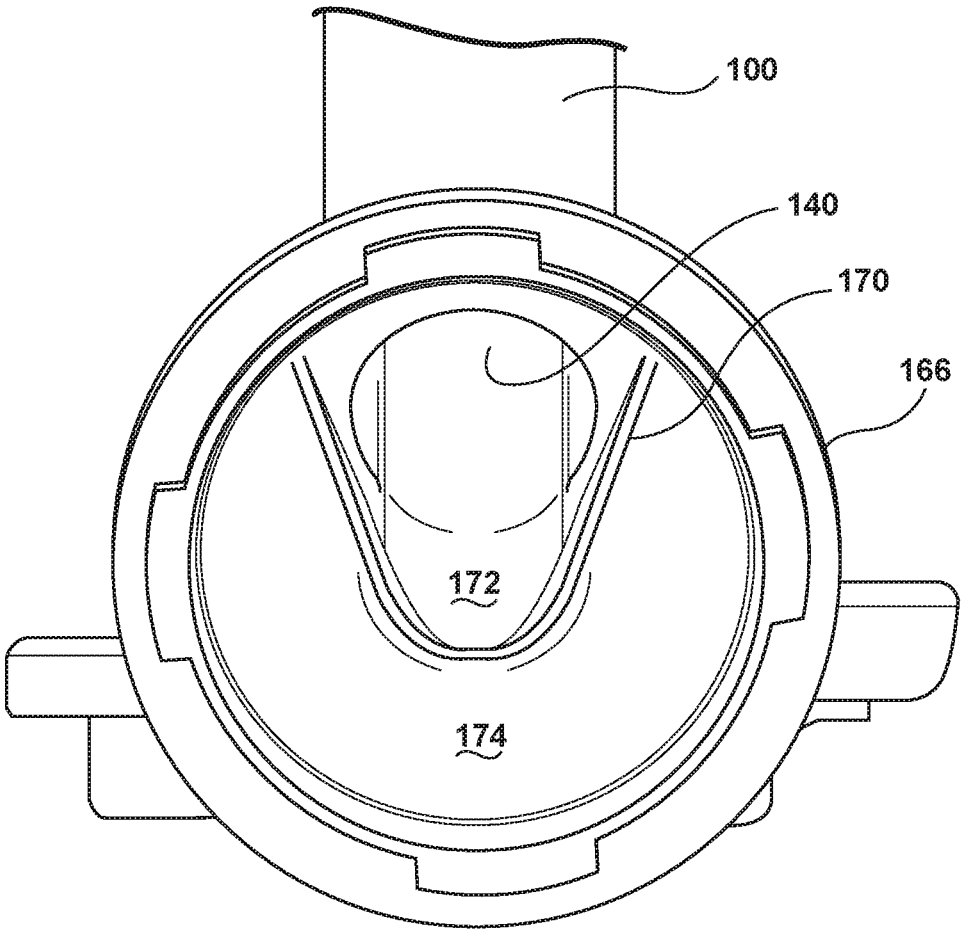
FIG. 5 is an end view of an outlet for the supply conduit of the spray arm assembly of FIG. 4.

As best seen in FIG. 5, the deflector 170 generally spans the depending wall 168. The deflector 170 is generally V-shaped in plan form, resulting in the first portion 172 having a generally triangular profile. The first portion 172 is smaller in cross-sectional area than the second portion 174 as well as the bearing body inlet 124.

It is contemplated that the cross-sectional area of the first portion 172 will be substantially similar to the cross-sectional area 176 of the hollow interior 140 that opens into the first portion 172, which will reduce any pressure drops. The reduction to elimination of the pressure drop associated with the transition from the liquid supply conduit 100 to the bearing assembly 104 will improve the spray performance of the rotating spray arm 102.

While the invention has been described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

The invention claimed is:

1. A dishwasher for treating dishes according to at least one automatic cycle of operation, the dishwasher comprising:

a tub at least partially defining a treating chamber receiving dishes for treating;

a controller configured to execute the at least one automatic cycle of operation; and, a spray arm assembly for spraying wash liquid in the tub, the spray arm assembly comprising:

a spray arm having a spray arm inlet;

a bearing assembly having a bearing body defining a through passage with a bearing inlet and a bearing outlet fluidly coupled to the spray arm inlet;

a liquid supply conduit having a supply outlet fluidly coupled to the bearing inlet;

a seal positioned between the bearing body and the liquid supply conduit; and a deflector provided within the supply outlet to effectively divide the supply outlet into at least two portions, with one of the at least two portions facing upstream and defining an effective cross-sectional area confronting the bearing inlet that is less than or equal to a cross-sectional area of the bearing inlet, the deflector aligned with the bearing inlet and defining a 90-degree turn in the supply outlet for directing liquid into the bearing inlet.

2. The dishwasher of claim 1, wherein the seal comprises a seat on one of the liquid supply conduit and bearing body, a shoulder overlying the seat on the other of the bearing body and liquid supply conduit, a seal element located in the seat, and a friction reducer between the seal element and one of the seat and the shoulder.

3. The dishwasher of claim 2, wherein the seal element is an O-ring and the friction reducer is a pair of stacked rings.

4. The dishwasher of claim 1, wherein the deflector defines a V-shaped terminal end when viewed from the through passage.

5. The dishwasher of claim 1, wherein the liquid supply conduit is horizontal.

6. The dishwasher of claim 1, wherein the through passage of the bearing body is vertical.

7. The dishwasher of claim 1, wherein the liquid supply conduit is positioned orthogonal to the through passage.

8. The dishwasher of claim 7, wherein the liquid supply conduit transitions 90 degrees to the supply outlet.

9. The dishwasher of claim 1, wherein the deflector defines a boundary between the at least two portions of the supply outlet.

10. The dishwasher of claim 1, wherein the liquid supply conduit comprises a supply conduit wall at least partially defining the supply outlet, and the bearing body has a bearing surface against which at least a portion of the supply conduit wall bears.

11. The dishwasher of claim 10, wherein at least a portion of the effective cross-sectional area is bound by the supply conduit wall and defines the cross-sectional area of the bearing inlet.

12. The dishwasher of claim 10, wherein the liquid supply conduit comprises a hemispherical portion defined by a portion of the supply conduit wall.

13. The dishwasher of claim 12, wherein the deflector and the interior of the hemispherical portion divide the supply outlet into the at least two portions.

* * * * *